US007749952B2

(12) United States Patent
Zhang et al.

(10) Patent No.: US 7,749,952 B2
(45) Date of Patent: Jul. 6, 2010

(54) FABRIC CARE COMPOSITIONS FOR SOFTENING, STATIC CONTROL AND FRAGRANCE BENEFITS

(75) Inventors: Shulin Larry Zhang, West Chester, OH (US); Renae Dianna Fossum, Middletown, OH (US); Michelle Marie Mulvaney, Cincinnati, OH (US); Daniel Dale Ditullio, Jr., Hamilton, OH (US); Glenn Thomas Jordan, IV, Indian Springs, OH (US)

(73) Assignee: The Procter & Gamble Company, Cinicnnati, OH (US)

( * ) Notice: Subject to any disclaimer, the term of this patent is extended or adjusted under 35 U.S.C. 154(b) by 363 days.

(21) Appl. No.: 11/633,831

(22) Filed: Dec. 5, 2006

(65) Prior Publication Data

US 2008/0132437 A1 Jun. 5, 2008

(51) Int. Cl.
*C11D 3/50* (2006.01)

(52) U.S. Cl. ..... 510/515; 510/101

(58) Field of Classification Search ..... 510/515–527, 510/101

See application file for complete search history.

(56) References Cited

U.S. PATENT DOCUMENTS

| | | | | |
|---|---|---|---|---|
| 4,162,984 | A | 7/1979 | DeBlock | |
| 4,237,016 | A | 12/1980 | Rudkin | |
| 4,439,330 | A | 3/1984 | Ooms | |
| 5,476,599 | A | 12/1995 | Rusche | |
| 5,559,088 | A | 9/1996 | Severns | |
| 5,830,835 | A | 11/1998 | Severns | |
| 6,165,953 | A | 12/2000 | Gardlik | |
| 6,277,796 | B1 | 8/2001 | Sivik | |
| 6,281,180 | B1 | 8/2001 | Tartakovsky et al. | |
| 6,858,575 | B2 | 2/2005 | Smets | |
| 6,916,769 | B2 | 7/2005 | McRitchie | |
| 2001/0006938 | A1 * | 7/2001 | Grainger et al. | 510/515 |
| 2003/0060390 | A1 * | 3/2003 | Demeyere et al. | 510/329 |
| 2003/0134772 | A1 | 7/2003 | Dykstra | |
| 2004/0142828 | A1 * | 7/2004 | Popplewell et al. | 510/101 |
| 2005/0123497 | A1 | 6/2005 | Dykstra | |

FOREIGN PATENT DOCUMENTS

| | | | |
|---|---|---|---|
| WO | WO 98/16538 | A1 | 4/1998 |
| WO | WO 00/02981 | | 1/2000 |
| WO | WO 00/02982 | | 1/2000 |
| WO | WO 00/02987 | | 1/2000 |
| WO | WO 00/02991 | | 1/2000 |
| WO | WO 00/70004 | A1 | 11/2000 |
| WO | WO 01/46361 | A1 | 6/2001 |
| WO | WO 2006/031946 | A1 | 3/2006 |

* cited by examiner

*Primary Examiner*—John R Hardee
(74) *Attorney, Agent, or Firm*—Stephen T. Murphy; Melissa G. Krasovec

(57) ABSTRACT

A fabric care composition containing non-ionic softening compounds, antistatic agents and perfume. Particularly, the fabric care composition is suitable for use in the rinse cycle of a textile laundering operation to provide excellent fabric softening/static control benefits, and surprisingly improved perfume freshness and longevity. The fabric care composition is preferably at a neutral pH.

12 Claims, No Drawings

FABRIC CARE COMPOSITIONS FOR SOFTENING, STATIC CONTROL AND FRAGRANCE BENEFITS

FIELD OF INVENTION

The present invention relates to a fabric care composition containing non-ionic softening compounds, antistatic agents and perfume. Particularly, it relates to a fabric care composition for use in the rinse cycle of a textile laundering operation to provide excellent fabric softening/static control benefits, and surprisingly improved perfume freshness and longevity.

BACKGROUND OF THE INVENTION

In developing fabric care compositions, the primary focus is on incorporation of the actives into the products and delivery of the actives onto the fabrics such that the treated fabrics exhibit the desired fabric care benefits. Through-the-rinse applications pose special challenges in the area of effective deposition from the rinse medium to the fabrics. In some cases, it is found that fabric care actives having cationic moieties and long alkyl chains (e.g., alkyl quats) are very sensitive to certain detergent components (e.g., anionic surfactant) that are carried over from the wash cycle into the rinse cycle. It is hypothesized that the anionic detergent components may interact with the cationic fabric care actives, forming cationic-anionic complexes that may precipitate out of the rinse medium and/or neutralize the softening actives. The former reduces deposition onto fabrics and the latter reduces effectiveness of the fabric care actives.

Additionally, prior fabric care compositions typically contain actives that require a low pH environment to be functional and stable. However, such compositions also contain other important actives, such as certain perfume microcapsule materials, silicone surfactants, quaternary ammonium compounds, that may undergo changes or become unstable and/or non-functional at low pH. Therefore, active ingredients that are stable and function in a neutral or higher pH environment are desirable in formulating fabric care compositions.

Fabric care compositions comprising nonionic softening actives have been disclosed. Examples of nonionic fabric softening actives include fatty acid partial esters of polyhydric alcohols and anhydrides, especially sucrose esters, sorbitan esters, glycerol esters and polyglycerol esters. To ensure effective deposition onto fabrics, these nonionic fabric care actives may be used in combination with other co-actives or deposition agents. Exemplary compositions comprising nonionic fabric softening actives and/or deposition agents are disclosed in U.S. Pat. No. 4,162,984; U.S. Pat. No. 4,237,016; U.S. Pat. No. 4,439,330; U.S. Pat. No. 5,476,599; U.S. Pat. No. 5,559,088; U.S. Pat. No. 5,830,835; U.S. Pat. No. 6,165,953; U.S. Pat. No. 6,277,796.

Furthermore, it is well recognized that consumer acceptance of a fabric care product is determined not only by the softening/static control performance of the product but also by the fragrance aesthetics it provides. It is also desired by consumers for treated fabrics to maintain over time the pleasing fragrance imparted by the treatment product.

However, the amount of perfume carried over from a laundering operation onto fabrics is often marginal and does not last long on the treated fabrics. The fragrance materials in the treatment product either fail to deposit onto the fabrics or are washed away. Additional amount of fragrance materials are released from the fabrics and lost through the dryer vent during the heat drying cycle. Each of these intrusions not only results in a diminished level of perfume raw materials, but also a loss of fragrance "balance" or aesthetic character. Since fragrance materials are expensive, the inefficient use in the product or in the delivery to fabrics results in a high cost to both the consumers and the product manufacturers.

Various fragrance materials have been found to react with amine-containing compounds and the resulting products have shown to provide long lasting perfume release from the treated fabrics. It has also been found that these fragrance materials and amine-containing compounds can be separately added to the product and still provide long lasting fragrance benefit. The amine-assisted perfume delivery systems are disclosed in, for example, WO 00/02991; WO 00/02981; WO 00/02982; WO 00/02987; U.S. Pat. No. 6,858,575; U.S. Pat. No. 6,916,769; US 2003/0,134,772; US 2005/0,123,497.

There is a continuing need to improve fabric care compositions to deliver efficient deposition and enhanced fabric care benefits. Further, there is a continuing need for more efficient and effective perfume delivery in fabric care products. There is also a continuing need for improving the perfume longevity as well as perfume balance on the treated fabrics. In addition, there is a continuing need to have a fabric care composition that is stable and function at neutral pH.

SUMMARY OF THE INVENTION

One aspect of the present invention relates to a fabric care composition comprising:

(a) one or more nonionic fabric softening agents comprising sucrose ester;
(b) an anti-static agent;
(c) a deposition agent comprising a polymer having primary or secondary amine moieties and a molecular weight of from about 10,000 to about 2,100,000 Daltons; and
(d) perfume;

wherein sucrose ester is the predominant component.

Another aspect of the present invention relates to methods of treating fabrics to provide one or more benefits of fabric softness, static control, perfume freshness and perfume longevity. The method comprises the step of contacting the fabrics with an effective amount of a fabric care composition of the present invention.

DETAILED DESCRIPTION OF THE INVENTION

Definitions

As used herein, "fabric article" means an article composed of fabrics and/or fibers. Such articles include, but are not limited to, clothing, towels and other bath linens, bed linens, table cloths, carpets, curtains, upholstery coverings, sleeping bags, tents, shoes, and car interior (such as car seat covers, car floor mats).

As used herein, "fabric care material" means a material or combination of materials that can deliver one or more of the following benefits to a fabric article: fabric softening, fabric lubrication, fabric relaxation, durable press, wrinkle resistance, wrinkle reduction, ease of ironing, abrasion resistance, fabric smoothing, anti-felting, anti-pilling, crispness, appearance enhancement, appearance rejuvenation, color protection, color rejuvenation, anti-shrinkage, in-wear shape retention, fabric elasticity, fabric tensile strength, fabric tear strength, static reduction, water absorbency or repellency, stain repellency, refreshing, anti-microbial, odor resistance, and mixtures thereof.

As used herein, "predominant" means the most abundant component of the composition. For purpose of this definition, the dispersing medium is not considered a "component" and is excluded from being considered as a "predominant" component. It is understood that the predominant component can comprise 100% of the composition. However, a predominant nonionic softener need not be more than 50% of all components present. For example, in a mixture of three components, A, B, and C, in the proportions A: 40%, B: 30% and C: 30%, A is by the present definition the predominant component of the composition. All percentages used in this definition refer to the weight percent of the composition.

As used herein, the articles "a" and "an", when used in a claim, are understood to mean one or more of the material that is claimed or described.

Unless otherwise noted, the "molecular weight" of a polymer refers to the weight average molecular weight and is expressed in Dalton units, which can be measured according to a gel permeation chromatography ("GPC") method described in U.S. Patent Publication 2003/0154883 A1.

Unless otherwise noted, all component or composition levels are in reference to the active level of that component or composition, and are exclusive of impurities, for example, residual solvents or by-products, which may be present in commercially available sources.

Unless otherwise indicated, all percentages and ratios are calculated based on weight percent of the total composition.

Fabric Care Composition

One aspect of the present invention is to provide a fabric care composition which comprises one or more nonionic fabric softeners having sucrose ester as the predominant component, an antistatic agent, a deposition agent which is a high molecular weight polymer having a primary or secondary amine moieties, perfume, and optionally, other adjunct materials.

In one embodiment, the nonionic softener comprises fatty acid partial esters of polyhydric alcohols and anhydrides, including sucrose esters, sorbitan esters, glycerol esters and polyglycerol esters. In another embodiment, sucrose ester is the predominant component of the fabric care composition. In another embodiment, the antistatic agent comprises quaternary ammonium compounds with fatty alkyl chains, such as di-tallow dimethyl ammonium chloride (DTDMAC). In another embodiment, the deposition agent comprises amino-functional polymers comprising primary or secondary amino moieties, such as polyvinyl amine, having a molecular weight of from about 10,000 to about 2,100,000. In another embodiment, the perfume is a perfume accord comprising one or more quadrant IV (enduing, fabric substantive) perfume ingredients and one or more quadrant I (volatile and hydrophilic) perfume ingredients. These perfume ingredients are characterized by their boiling point and ClogP value, which are disclosed in more detail in the "Perfume" section. In another embodiment, the dispersing medium is water or lower alcohols, preferably water is the major (at least about 50%) component of the dispersing medium.

In another embodiment, the fabric care composition further comprises one or more adjunct materials selected from the group consisting of ionic fabric softening agents, other antistatic agents, other perfume materials, wetting agents, viscosity modifiers, pH buffers, antibacterial agents, antioxidants, radical scavengers, chelants, antifoaming agents, and mixtures thereof.

In another embodiment, the fabric care composition comprises from about 5% to about 70% by weight of the fabric care composition of a nonionic softener such as fatty acid partial esters of polyhydric alcohols and anhydrides, from about 0.1% to about 20% by weight of the fabric care composition of an antistatic agent such as quaternary ammonium compound, from about 0.1% to about 10% by weight of the fabric care composition of a deposition agent such as amino-functional polymers comprising primary or secondary amino moieties and having a molecular weight of at least about 10,000, from about 0.01% to about 5% by weight of the fabric care composition of a perfume accord, and the balance a dispersing medium such as water.

In another embodiment, the fabric care composition comprises a nonionic fabric softener and a static control agent having the weight ratio ranging from about 10:1 to about 1:1, or from about 5:1 to about 1:1, or from about 2:1 to about 1:1.

In another embodiment, the weight ratio of the nonionic fabric softener to the polymeric deposition agent ranges from about 300:1 to about 3:1, or from about 100:1 to about 5:1, more preferably from about 50:1 to about 10:1

In another embodiment, the weight ratio of the polymeric deposition agent to the perfume accord ranges from about 10:1 to about 1:1, or from about 1:20 to about 1:3.

In another embodiment, the fabric care composition comprises from about 5% to about 70% by weight of the composition of sucrose ester, from about 1% to about 8% by weight of the composition of DTDMAC, from about 0.05% to about 5% by weight of the composition of polyvinylamine, from about 0.01% to about 5% by weight of the composition of a perfume accord comprising Quadrant I and IV PRMs, and from about 30% to about 98% by weight of the composition of water, and optionally from about 0.1% to about 15% by weight of the composition of one or more adjunct materials.

The fabric care composition of the present invention preferably has a neutral pH. In some embodiments the pH of the fabric care composition may be in one of the following ranges: from about 5.5 to about 8.5, or from about 6 to about 8, or from about 6.5 to about 7.5. Commonly known pH buffers, such as citric acid, lactic acid, succinic acid, phosphoric acid, sodium bicarbonate, and mixtures thereof, can be used to adjust and/or control the pH of the composition.

The liquid compositions of the present invention can be used by manual pouring from a container or by using a mechanical dispensing device. The liquid compositions of the present invention typically have a viscosity of less than about 2000 centipoises (2 Pa·s), preferably less than about 500 centipoises (0.5 Pa·s), more preferably less than about 200 centipoises (0.2 Pa·s), and even more preferably less than about 120 centipoises (0.12 Pa·s). For purposes of the present invention, the viscosities of the present compositions are measured at 25° C. with a Brookfield® viscometer using a No. 2 spindle at 60 rpm.

The present compositions are preferably liquid compositions. Liquid compositions of the present invention can be clear or opaque (dispersions). The present compositions can also be provided in a unit dose form, for example, as a liquid composition contained in a water-soluble film (e.g. polyvinyl alcohol film) or as a solid tablet unit dose form. Non-limiting examples of unit dose articles are described in US 2005/0202990 A1. The present composition can also be provided in or on a sheet substrate.

The compositions of the present invention can also be dosed in the laundry process through other means such as hand pump, squeeze bottle, squeeze tube, bars, granules, particles or other forms that can be dispersed into the wash or rinse liquor with or without addition device.

The present invention also encompasses using the compositions to treat fabrics during in a laundering process. The present invention thus further relates to methods of treating fabrics; the method comprises the step of contacting the fabrics with an effective amount of a fabric care composition of the present invention; the contacting step can occur during the wash cycle and/or the rinse cycle in an automatic laundry machine. It can also be conducted in a hot air clothes dryer.

The present invention thus further relates to methods of treating fabrics to provide one or more benefits selected from the group consisting of fabric softening, fabric lubrication, fabric relaxation, durable press, wrinkle resistance, wrinkle reduction, ease of ironing, abrasion resistance, fabric smoothing, anti-felting, anti-pilling, crispness, appearance enhancement, appearance rejuvenation, color protection, color rejuvenation, anti-shrinkage, in-wear shape retention, fabric elasticity, fabric tensile strength, fabric tear strength, static reduction, water absorbency or repellency, stain repellency, refreshing, anti-microbial, odor resistance.

Nonionic Fabric Softening Agents

The compositions of the present invention contain one or more nonionic fabric softening agents, such as fatty acid partial esters of polyhydric alcohols, or anhydrides thereof. The polyhydric alcohol or anhydride portion contains from about 2 to about 18, preferably from about 2 to about 12, carbon atoms, and each fatty acid moiety contains from about 8 to about 30, preferably from about 12 to about 20, carbon atoms. Non-limiting examples of the polyhydric alcohol portion of the ester can be ethylene glycol, glycerol, poly (e.g., di-, tri-, tetra, penta-, and/or hexa-) glycerol, xylitol, sucrose, erythritol, pentaerythritol, sorbitol or sorbitan. The fatty acid portion of the ester is normally derived from fatty acids having from about 8 to about 30, preferably from about 12 to about 22, carbon atoms. Typical examples of said fatty acids being lauric acid, myristic acid, palmitic acid, stearic acid, oleic acid, and behenic acid. Typically, such softeners contain from about one to about three, preferably about two fatty acid groups per molecule.

The nonionic fabric softeners typically comprise sucrose esters. Sucrose ester is composed of a sucrose moiety having one or more of its hydroxyl groups esterified.

Sucrose is a disaccharide having the following formula:

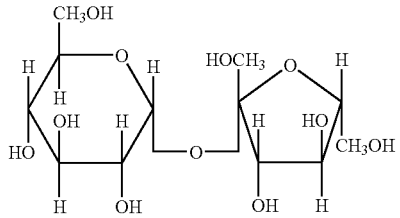

Alternatively, the sucrose molecule can be represented by the formula: $M(OH)_8$, wherein M is the disaccharide backbone and there are total of 8 hydroxyl groups in the molecule.

Thus, sucrose esters can be represented by the following formula:

$$M(OH)_{8-x}(OC(O)R^1)_x$$

wherein x is the hydroxyl groups that are esterified and (8-x) is the hydroxyl groups that remain unchanged; x is an integer selected from 1 to 8, or from 2 to 8, or from 3 to 8, or from 4 to 8; and $R^1$ moieties are independently selected from C1-C22 alkyl or C1-C30 alkoxy, linear or branched, cyclic or acyclic, saturated or unsaturated, substituted or unsubstituted. Substituent groups can include, for example, hydroxyl, halide, alkoxy, and the like.

In one embodiment, the $R^1$ moieties comprise linear alkyl or alkoxy moieties having independently selected and varying chain length. For example, $R^1$ may comprise a mixture of linear alkyl or alkoxy moieties wherein greater than about 20% of the linear chains are C18, or greater than about 50% of the linear chains are C18, or greater than about 80% of the linear chains are C18.

In another embodiment, the $R^1$ moieties comprise a mixture of saturate and unsaturated alkyl or alkoxy moieties; the degree of unsaturation can be measured by "Iodine Value" (hereinafter referred as "IV", as measured by the standard AOCS method). The IV of the sucrose esters suitable for use herein ranges from about 1 to about 150, or from about 2 to about 100, or from about 5 to about 85. The $R^1$ moieties may be hydrogenated to reduce the degree of unsaturation.

In a further embodiment, the unsaturated $R^1$ moieties may comprise a mixture of "cis" and "trans" forms about the unsaturated sites. The "cis"/"trans" ratios may range from about 1:1 to about 50:1, or from about 2:1 to about 40:1, or from about 3:1 to about 30:1, or from about 4:1 to about 20:1.

The sucrose esters are present in the fabric care composition of the present invention at levels from about 1% to about 70%, or from about 2% to about 50%, or from about 3% to about 30%, by weight of the composition.

Optionally, adjunct nonionic softening agents may also be used in the present invention; the adjunct nonionic softening agents include, but are not limited to, sorbitan esters and glycerol and polyglycerol esters. Each adjunct nonionic softening agent is present at a level less than about ⅔, or less than about ⅕, or less than about 1/10 the level of sucrose ester in the composition.

Sorbitan esters are esterified dehydration products of sorbitol. Suitable sorbitan ester may comprise a member selected from the group consisting of $C_{10}$-$C_{26}$ acyl sorbitan monoesters and $C_{10}$-$C_{26}$ acyl sorbitan diesters and ethoxylates of said esters wherein one or more of the unesterified hydroxyl groups in said esters contain from 1 to about 6 oxyethylene units, and mixtures thereof. In one embodiment of the present invention, sorbitan esters containing unsaturation (e.g., sorbitan monooleate) can be utilized. In another embodiment, the sorbitan ester may be a mixture of mono-, di-, tri- and higher sorbitan esters, for example, an ester mixture having from 20-50% mono-ester, 25-50% di-ester and 10-35% of tri- and tetra-esters. It will be recognized that the term "sorbitan" is meant to include mixtures containing sorbitol anhydrides (such as 1,4- and 1,5-sorbitol anhydrides, isosorbide) as well as free, uncyclized sorbitol. Exemplary sorbitan esters include sorbitan monostearate (typically include its di- and tri-esters analogs), sorbitan stearate/palmitate mixtures, sorbitan monolaurate, sorbitan monomyristate, sorbitan monopalmitate, sorbitan monobehenate, sorbitan monooleate, sorbitan dilaurate, sorbitan dimyristate, sorbitan dipalmitate, sorbitan distearate, sorbitan dibehenate, sorbitan dioleate, mixed tallowalkyl sorbitan mono- and di-esters, and mixtures thereof.

Glycerol and polyglycerol esters, especially glycerol, diglycerol, triglycerol, and polyglycerol mono- and/or di-esters, preferably mono-, can be used herein as adjunct nonionic fabric softeners. Exemplary glycerol and polyglycerol esters include mono-esters with stearic, oleic, palmitic, lauric, isostearic, myristic, and/or behenic acids and the diesters of stearic, oleic, palmitic, lauric, isostearic, behenic, and/or myristic acids. It is understood that the typical mono-ester contains some di-, tri- and higher esters. Polyglycerol esters include diglycerol through octaglycerol esters. The polyglycerol polyols are formed by condensing glycerin or epichlorohydrin together to link the glycerol moieties via ether linkages. The mono- and/or diesters of the polyglycerol polyols are preferred, the fatty acyl groups typically being those described hereinbefore for the glycerol esters.

Antistatic Agents

The fabric care compositions of the present invention contain antistatic agents such as fatty alkyl quaternary ammonium compounds; diester quaternary ammonium compounds (DEQA); polyquaternary ammonium compounds; triethanolamine esterified with carboxylic acid and quaternized (so called "esterquat"); amino esterquats; cationic diesters; betaine esters; and mixtures thereof. More detailed descriptions of these and other softening agents are disclosed in EP 902 009; WO 99/58492; WO 97/08284; WO 99/27050; WO 00/70004; WO 00/70005; WO 01/46361; WO 01/46363; WO 99/64661; WO 99/64660; JP 11-350349; JP 11-081134; JP 11-043863; U.S. Pat. No. 4,137,180; U.S. Pat. No. 4,906,413; U.S. Pat. No. 5,194,667; U.S. Pat. No. 5,235,082; U.S. Pat. No. 5,670,472; U.S. Pat. No. 5,747,443; U.S. Pat. No. 5,759,990; U.S. Pat. No. 6,323,172; U.S. Pat. No. 6,369,025; and U.S. Pat. No. 6,486,121.

Some of the softening agents are described in details below. Suitable protonable amines include protonable amines having Formula I below:

Formula I $$(R)_{3-m}N-[(CH_2)_n-Q-R^1]_m$$

wherein the index m=0, 1, 2 or 3; the index n=1, 2, 3 or 4, preferably n is 2 or 3, more preferably n is 2; each $R^1$ is independently selected from $C_1$-$C_{22}$ alkyl, $C_1$-$C_{22}$ hydroxyalkyl or a benzyl group; each $R^1$ is independently selected from $C_{11}$-$C_{22}$ linear alkyl, $C_{11}$-$C_{22}$ branched alkyl, $C_{11}$-$C_{22}$ linear alkenyl, or $C_{11}$-$C_{22}$ branched alkenyl; and each Q may comprise a carbonyl, carboxyl, or amide moiety.

Suitable alkylated quaternary ammonium compounds (quats), include mono-alkyl quats, di-alkyl, tri-alkyl quats and tetra-alkyl quats and certain cationic surfactants. Suitable mono-alkyl quats, di-alkyl, tri-alkyl quats and tetra-alkyl quats typically have Formula II below:

Formula II $$\left[(R)_{4-m}\overset{+}{N}-[(CH_2)_n-Q-R^1]_m\right]X^-$$

wherein the index m=0, 1, 2, 3 or 4; the index n=1, 2, 3 or 4, preferably n is 2 or 3, more preferably n is 2; each R is independently selected from $C_1$-$C_{22}$ alkyl, $C_1$-$C_{22}$ hydroxyalkyl, or a benzyl group; each $R^1$ is independently selected from $C_{11}$-$C_{22}$ linear alkyl, $C_{11}$-$C_{22}$ branched alkyl, $C_{11}$-$C_{22}$ linear alkenyl, or $C_{11}$-$C_{22}$ branched alkenyl; $X^-$ is a water soluble anionic species such as chloride, bromide or methyl sulfate, and Q may comprise a carbonyl, carboxyl, or amide moiety.

Nonlimiting examples of quaternary ammonium type antistatic agents may be selected from the group consisting of: N,N-dimethyl-N,N-di(tallowyloxyethyl)ammonium methylsulfate, N-methyl-N-hydroxyethyl-N,N-di(canoyloxyethyl) ammonium methylsulfate, N,N-ditallow N,N-dimethyl ammonium chloride (DTDMAC), N,N-ditallowylethanol N,N-dimethyl ammonium chloride, and mixtures thereof. These and other quaternary ammonium type fabric softeners are commercially available under the trade names Adogen®, Reweoquat®, Varisoft® (all are available from Degussa) and Armosoft® (from Akzo).

The antistatic agent comprises, based on total composition weight, at the following levels, from about 0.1% to about 20%, or from about 0.2% to about 15%, or from about 0.2% to about 10 wt %, or from about 0.2% to about 5%.

Deposition Agents

The fabric care compositions of the present invention further comprise deposition agents, such as amino functional polymers. Suitable amino functional polymers typically comprise at least one free, unmodified primary and/or secondary amino group that is attached to the polymer backbone or to a polymer side chain. The amino functional polymers generally has a weight average molecular weight in the range of from about 10,000 to about 5,000,000, or from about 100,000 to about 2,000,000, or from about 250,000 to about 1,000,000. In one embodiment, the deposition agent is polyacrylamide or derivatives thereof, and the molecular weight of the deposition agent ranges from about 100,000 to about 2,100,000.

The deposition agent comprises, based on total composition weight, at the following levels, from about 0.01% to about 20%, or from about 0.05% to about 15%, or from about 0.1% to about 10 wt %.

Exemplary amino functional polymers include polyvinylamines, alkylene polyamines including polyalkyleneimines, polyaminoacids, amino substituted polyvinylalcohols, polyoxyethylene bis-amine or bis-aminoalkyl, derivatives thereof, and mixtures thereof. The term "derivatives thereof" is meant to encompass co-polymers, branched variants and alkoxylated variants.

Exemplary polyvinylamines and derivatives include polyvinylamine having a molecular weight of from about 10,000 to about 2,100,000; polyvinylamine alkoxylates which are alkoxylated derivatives thereof and have a degree of alkoxylation, preferably ethoxylation, of about 0.5; polyvinylamine vinylalcohol copolymers; polyvinylamine vinylformamide copolymers.

Exemplary polyamines and derivatives include polyethyleneimine (PEI), partially alkoxylated PEI, hydroxylated polyethyleneimine (PEI-E), polyamido polyenthyleneimine (PAMAM) dendrimer.

Polyamino acids are compounds made of amino acids or chemically modified amino acids, which include, but are not limited to alanine, serine, aspartic acid, arginine, glutaminc acid, lysine, glutamine, tyrosine, tryptophan, phenylalanine, praline, histidine, methionine, lysine, and the like. Exemplary polyamino acids include polylysine, partially ethoxylated derivatives thereof, crosslinked derivative thereof (e.g. condensation of some of the amino groups with carboxy functional groups or with known crosslinkers), copolymers with other amino acids or other acid, amide or acyl chloride reagents, such as aminocaproic acid, adipic acid, ethylhexanoic acid, caporlactam, or mixtures thereof.

Commercially available amino function polymers suitable for use herein are disclosed. Suitable polyvinylamine (PVAm) are available as Lupamin® 9095, 5095, 1595, Catiofast® PR8085, PR8106, PR8134, all of which are from BASF. Suitable polyethyleneimine (PEI): examples of this polymeric material are available as Lupasol® and Polymin® from BASF, or as Catiofast® PL, SF, GM, PR8138, all of which are from BASF. Suitable polyamines are also available from Mitsubishi (under the trade name Jeffamines®) and Clariant. Suitable PAMAM are available as Starburst® from Dendritech. Polylysine and derivatives thereof as well as other polyamino acids containing lysine, arginine, glutamine, asparagines available from Sigma, Applichem, Bachem and Fluka.

Other suitable deposition agents are acyclic polymers or copolymers derived from monomers having nitrogen moieties, including but not limited to, amine, imine, amide, imide, acrylamide, methacrylamide, amino acid, and mixtures thereof. Examples of such deposition agents are described in U.S. Patent Application Ser No. 60/687,362 (P&G case 10013P).

Perfume

As used herein, the term "perfume" encompasses the perfume raw materials (PRMs) and perfume accords. The term "perfume raw material" as used herein refers to compounds having a molecular weight of at least about 100 g/mol and which are useful in imparting an odor, fragrance, essence or scent, either alone or with other perfume raw materials. As used herein, the terms "perfume ingredient" and "perfume raw material" are interchangeable. The term "accord" as used herein refers to a mixture of two or more PRMs.

Typical PRM comprise inter alia alcohols, ketones, aldehydes, esters, ethers, nitrites and alkenes, such as terpene. A listing of common PRMs can be found in various reference sources, for example, "Perfume and Flavor Chemicals", Vols. I and II; Steffen Arctander Allured Pub. Co. (1994) and "Perfumes: Art, Science and Technology", Miller, P. M. and Lamparsky, D., Blackie Academic and Professional (1994).

The PRMs are characterized by their boiling points (B.P.) measured at the normal pressure (760 mm Hg), and their octanol/water partitioning coefficient (P). Octanol/water partitioning coefficient of a PRM is the ratio between its equilibrium concentration in octanol and in water.

The logP of many PRMs has been reported; for example, the Pomona92 database, available from Daylight Chemical Information Systems, Inc. (Daylight CIS), Irvine, Calif., contains many, along with citations to the original literature. However, the logP values are most conveniently calculated by the "CLOGP" program, also available from Daylight CIS. This program also lists experimental logP values when they are available in the Pomona92 database. The "calculated logP" (ClogP) is determined by the fragment approach on Hansch and Leo (cf., A. Leo, in Comprehensive Medicinal Chemistry, Vol. 4, C. Hansch, P. G. Sammens, J. B. Taylor and C. A. Ransden, Eds., p. 295, Pergamon Press, 1990, incorporated herein by reference). The fragment approach is based on the chemical structure of each PRM, and takes into account the numbers and types of atoms, the atom connectivity, and chemical bonding. The ClogP values, which are the most reliable and widely used estimates for this physicochemical property, are preferably used instead of the experimental logP values in the selection of PRMs which are useful in the present invention.

The boiling points of many PRMs are given in, e.g., "Perfume and Flavor Chemicals (Aroma Chemicals)," S. Arctander, published by the author, 1969, incorporated herein by reference. Other boiling point values can be obtained from different chemistry handbooks and databases, such as the Beilstein Handbook, Lange's Handbook of Chemistry, and the CRC Handbook of Chemistry and Physics. When a boiling point is given only at a different pressure, usually lower pressure than the normal pressure of 760 mm Hg, the boiling point at normal pressure can be approximately estimated by using boiling point-pressure nomographs, such as those given in "The Chemist's Companion," A. J. Gordon and R. A. Ford, John Wiley & Sons Publishers, 1972, pp. 30-36.

Perfume raw materials having a B.P. of about 250° C. or higher and a ClogP of about 3.0 or higher are called Quadrant IV perfumes or enduring perfumes. Non-limiting examples of enduring perfumes include allyl cyclohexane propionate, ambrettolide, amyl benzoate, amyl cinnamate, amyl cinnamic aldehyde, amyl cinnamic aldehyde dimethyl acetal, iso-amyl salicylate, hydroxycitronellal-methyl anthranilate (known as aurantiol®), benzophenone, benzyl salicylate, para-tert-butyl cyclohexyl acetate, iso-butyl quinoline, beta-caryophyllene, cadinene, cedrol, cedryl acetate, cedryl formate, cinnamyl cinnamate, cyclohexyl salicylate, cyclamen aldehyde, dihydro isojasmonate, diphenyl methane, diphenyl oxide, dodecalactone, 1-(1,2,3,4,5,6,7,8-octahydro-2,3,8,8-tetramethyl-2-naphthalenyl)-ethanone (known as iso E super®), ethylene brassylate, methyl phenyl glycidate, ethyl undecylenate, 15-hydroxypentadecanoic acid lactone (known as exaltolide®), 1,3,4,6,7,8-hexahydro-4,6,6,7,8,8-hexamethyl-cyclopenta-gamma-2-benzopyran (known as galaxolide®), geranyl anthranilate, geranyl phenyl acetate, hexadecanolide, hexenyl salicylate, hexyl cinnamic aldehyde, hexyl salicylate, alpha-irone, gamma-ionone, gamma-n-methyl ionone, para-tertiary-butyl-alpha-methyl hydrocinnamic aldehyde (known as lilial®), lilial (p-t-bucinal)®, linalyl benzoate, 2-methoxy naphthalene, methyl dihydrojasmone, musk indanone, musk ketone, musk tibetine, myristicin, oxahexadecanolide-10, oxahexadecanolide-11, patchouli alcohol, 5-acetyl-1,1,2,3,3,6-hexamethylindan (known as phantolide®), phenyl ethyl benzoate, phenylethylphenylacetate, phenyl heptanol, phenyl hexanol, alpha-santalol, delta-undecalactone, gamma-undecalactone, vetiveryl acetate, yara-yara, ylangene.

Perfume raw materials having a B.P. lower than 250° C. and a ClogP lower than 3.0 are called Quadrant I perfumes. Non-limiting examples of Quadrant I perfumes include anisic aldehyde, benzaldehyde, benzyl acetate, laevo-carvone, geraniol, hydroxycitronellal, cis-jasmone, linalool, nerol, phenyl ethyl alcohol, alpha-terpineol.

Perfume raw materials having a B.P. of about 250° C. or higher and a ClogP lower than 3.0 are called Quadrant II perfumes. Non-limiting examples of Quadrant II perfumes include coumarin, eugenol, iso-eugenol, indole, methyl cinnamate, methyl dihydrojasmonate, methyl-N-methyl anthranilate, beta-methyl naphthyl ketone, delta-Nnonalactone, vanillin.

Perfume raw materials having a B.P. less than 250° C. and a ClogP higher than about 3.0 are called Quadrant III perfumes. Non-limiting examples of Quadrant III perfumes include iso-bornyl acetate, carvacrol, alpha-citronellol, para-cymene, dihydro myrcenol, geranyl acetate, d-limonene, linalyl acetate, vertenex.

In some compositions of the present invention, some non-enduring perfume ingredients can be used in small amounts, e.g., to improve the perfume odor or "balance". However, to minimize waste and pollution, the perfume accord useful herein contains less than about 30%, preferably less than about 20%, more preferably less than about 15% by weight of the perfume accord of non-enduring perfume ingredients. Non-enduring perfume ingredients encompass Quadrant I, II and III perfume ingredients.

The perfume raw materials and accords may be obtained from one or more of the following perfume material suppliers Firmenich (Geneva, Switzerland), Givaudan (Argenteuil, France), IFF (Hazlet, N.J.), Quest (Mount Olive, N.J.), Bedoukian (Danbury, Conn.), Sigma Aldrich (St. Louis, Mo.), Millennium Specialty Chemicals (Olympia Fields, Ill.), Polarone International (Jersey City, N.J.), Fragrance Resources (Keyport, N.J.), and Aroma & Flavor Specialties (Danbury, Conn.).

Traditionally, non-enduring perfumes, especially Quadrant I perfume ingredients, are considered difficult to deposit onto fabrics. It is surprising to find that the composition of the present invention provide enhanced perfume delivery to fabrics of enduring perfume ingredients as well as non-enduring perfume ingredients. It is more surprising to find the composition of the present invention show significantly enhanced delivery of some Quadrant I perfume ingredients. Quadrant I perfume ingredients are hydrophilic and low boiling, thus, they are easily lost to the wash or rinse medium or during heat drying. Quadrant I perfume ingredients are traditionally considered the most challenging to deposit onto fabrics effectively.

Dispersing Medium

The fabric care composition of the present invention optionally comprises a dispersing medium. Suitable dispersing medium include, but are not limited to, water and solvents, preferably water soluble solvents selected from the group consisting of C4 to C10 glycol ethers, C2 to C7 glycols, polyethers, such as glycerin, and mixtures thereof.

The fabric care composition may comprise, based on weight percent of the fabric care composition, from about 30 wt % to about 99 wt %, or from about 40 wt % to about 90 wt %, or from about 50 wt % to about 70 wt % of the dispersing medium. In one embodiment, water comprises greater than about 30 wt %, or greater than about 60 wt % and less than about 99 wt % of the fabric care composition; the balance of the dispersing medium comprises water-soluble or water-dispersible solvents.

Non-limiting examples of solvents include ethanol, propanol, isopropanol, n-butanol, t-butanol, propylene glycol, ethylene glycol, dipropylene glycol, propylene carbonate, butyl carbitol, phenylethyl alcohol, 2-methyl 1,3-propanediol, hexylene glycol, glycerol, polyethylene glycol, 1,2-hexanediol, 1,2-pentanediol, 1,2-butanediol, 1,4-cyclohexanediol, pinacol, 1,5-hexanediol, 1,6-hexanediol, 2,4-dimethyl-2,4-pentanediol, 2,2,4-trimethyl-1,3-pentanediol, 2-ethyl-1,3-hexanediol, phenoxyethanol, or mixtures thereof.

In a typical embodiment, solvents are present in the fabric care compositions at a level of less than about 20%, preferably less than 10% by weight of the composition.

Scavengers

Optionally, the compositions of the present invention may also contain cationic polysaccharides as scavengers for anionic detergent components that are carried over from the wash cycle. These errant anionic components tend to bind or form complexes with the cationically charged antistatic agents, which may reduce their deposition efficiency as well as their care performance on the treated fabrics. The errant anionic components may also reduce the deposition of nonionic fabric softening agents on fabrics. Without being bound by theory, it is hypothesized that the cationic scavengers may serve as the sacrificial receptors for the anionic detergent components. Moreover, it is desirable to use the cheaper cationic polysaccharides to consume the anionic detergent components such that the more expensive antistatic agents can be utilized more efficiently.

The term "cationic polysaccharide" refers to a polysaccharide that has been chemically modified to provide the polysaccharide with a net positive charge in a pH neutral aqueous medium. Non-modified polysaccharides, such as starch, cellulose, pectin, carageenan, guar gums, xanthans, dextrans, curdlans, chitosan, chitin, and the like, can be chemically modified to impart cationic charges thereon. A common chemical modification incorporates quaternary ammonium substituents to the polysaccharide backbones. Additional chemical modifications may include cross-linking, stabilization reactions (such as alkylation and esterification), phophorylations, hydrolyzations. Exemplary cationic polysaccharides include cationic guar gums, cationic cellulose derivatives, hydrolyzed cationic starch, cationic chitosan derivatives, and mixtures thereof. In one embodiment of the composition of the present invention, the cationic polysaccharide is a hydrolyzed cationic starch (HCP). A suitable method of hydrolyzing starch is described by U.S. Pat. No. 4,499,116, with specific mention to column 4.

Commercial available cationic polysaccharides suitable for use in the present invention include, but are not limited to, Jaguar® (cationic guar polymers from Rhodia), Polygel® (cationic starches from Sigma), Softgel®, Amylofax® and Solvitose® (cationic starches from Avebe), Celquats® (cationic cellulose derivatives from National Starch), and Ucare® (cationic cellulose derivatives from Amerchol). Suitable cationic starches for use in the present compositions include, but are not limited to, C*Bond® available from Cerestar and Cato® available from National Starch and Chemical Company.

If used, the cationic polysaccharides are present in the fabric care composition of the present invention at levels from about 0.1% to about 5%, or from about 0.5% to about 3%, or from about 1% to about 2%, by weight of the composition. In one embodiment, HCP is present at from about 1 to about 2.5% by weight of the composition.

Adjunct Materials

The fabric care composition may optionally comprise adjunct materials. Adjunct materials include, but are not limited to, fabric care materials, perfumes, wetting agents, nonionic polymers, viscosity modifiers, pH buffers, antibacterial agents, antioxidants, radical scavengers, chelants, antifoaming agents, and mixtures thereof.

Except where noted otherwise, each adjunct material is optionally present, based on total composition weight, at the following levels, no more than about 30 wt %, or no more than about 20 wt %, or no more than about 10 wt %; and greater than about 0.01 wt %, or greater than about 0.1 wt %, or greater than about 1 wt %.

Additional adjunct materials further include, but are not limited to, wrinkle releasing/prevention agent, crystal modifier, soil release/prevention agent, colorant, brightener, odor reducer/eliminator, deodorizer/refresher agent, stain repellent, color enhancer, perfume release and/or delivery agent, shape retention agent, fiber rebuild agent, fiber repair agent, and mixtures thereof. Additional examples of suitable adjuncts and levels of use are found in U.S. Pat. No. 6,653,275.

Test Methods

Fabric Sample Preparation

The test fabrics are 86/14 cotton/poly terry towels (obtained from EMC, 7616 Reinfold Drive, Cincinnati, Ohio 45237). The fabrics are laundered and dried in automatic washer and dryer; appropriate amount of the sample composition or comparative composition is added during the rinse cycle. Details of the fabric treating conditions are disclosed in U.S. Pat. No. 6,413,920 (except that Miele washer and dryer are replaced with Kenmore 80 Series Heavy Duty Super Capacity Plus machines). Subsequently, the treated fabric is stored in a sealed aluminum envelope and stored in a sealed glass jar to preserve it until it is ready to be analyzed by headspace gas chromatography (HSGC). Prior to the HSGC test, the treated fabric is cut into small pieces (about 0.45-0.65 grams each). Fabric sample comprises pieces taken from various locations of the treated fabrics to ensure an even sampling of the treated fabric. A total amount of 4.0-4.2 grams of fabric pieces are collected and weighed; the weight is recorded. The weights of fabric samples in a given test should be within ±0.02 g of one another.

Headspace Gas Chromatography (HSGC)

The headspace gas chromatography (HSGC) is capable of determining the amount of each perfume raw material deposited onto the treated fabric. A suitable equipment is described by S. Maeno and P. A. Rodriguez in J. Chromatography, vol. A731 (1996) pages 201-215. The equipment includes:

1) a headspace collector to contain the substrate (treated and air dried as described above) and allow PRM(s) to partition into the headspace and reach equilibrium;

2) a trap containing a porous polymer, which has the ability to retain fragrance materials (such as perfume raw materials), preferably Tenax® TA 35/60 mesh (available from Gerstel, Inc., Baltimore, Md.);

3) a transfer device to transfer the trapped headspace vapors onto a GC for quantitative analysis; and 4) GC-MS with headspace detection capabilities, and uses helium as the mobile phase.

A fabric sample prepared according to the above procedure is placed in the headspace collector. Heat is applied such that the sample is held at 120 C for 40 minutes. Then, the trap is operatively connected to the headspace collector to capture the equilibrated headspace vapors. The transfer device is used to transfer the trapped headspace vapors, which contains perfume raw materials, onto a GC for quantitative analysis. This transfer device is able to heat the porous polymer trap containing the collected headspace vapors, and transfer the vapors to a cold trap cooled to lower than about −100° C. (generally by liquid nitrogen). Following complete transfer to the cold trap, the cold trap is flash heated in a short period of time, typically about 1 minute, to a temperature of about 280° C., resulting in the transfer of the headspace vapors directly onto a capillary GC column.

A typical column is a 30 to 60 meters long with an inner diameter of 0.18 to 0.32 mm, with a stationary phase, which can be, 100% dimethylpolysiloxane (a DB-5 column) or phenylmethylpolysiloxane containing about 5% phenyl. The GC-MS has the capability of identifying and quantifying PRMs of the aldehyde-, ketone-, alcohol- or terpene-type. Identification is accomplished via Mass Spectrometry and quantification is performed using a separate detector, such as FID (flame ionization detector) or PID (photo ionization detector). Specific GC/MS conditions are described below.

The perfume components are separated on a DB-5 column (dimethylsiloxane, 60 m×0.32 mm, 0.25 μm) in split mode to both an MS (for identification) and FID (for quantization). GC conditions are as following: the sample is held at oven temperature of about 35° C. for 2 min, then the GC is programmed to ramp up to 200° C. at 4° C./min, followed by a ramp to 325° C. at 10° C./min. Inlet pressure is kept constant at 13.7 psi (9.45 $N/m^2$), which is equivalent to an inert gas (e.g., helium) flow of about 2.4 mL/min. MS conditions are as following: scan range 35 to 400 amu (atomic units). Transfer line is maintained at about 250° C.

The quantitative measurements should be reproducible to within 20% of the average from the runs. If the result from a given run is not within said range, the data from said run should be discarded and the test repeated. The average of at least 3 satisfactory runs is reported.

EXAMPLES

The following compositions are examples of fabric care compositions useful in the present invention:

Examples

The following are examples of fabric care compositions according to the present invention.

| | EXAMPLES | | | | |
|---|---|---|---|---|---|
| Component | I | II | III | IV | V |
| Sucrose fatty ester[a] | 10 | 14 | 12 | 10 | 10 |
| DTDMAC[b] | 4 | 0 | 1.3 | 4 | 1.3 |
| PVAm[c] | 0.5 | 0.5 | 0.5 | 1.0 | 0.75 |
| Cationic polysaccharide[d] | 2 | 2 | 2 | 2 | 2 |
| Perfume | 1.5 | 1.5 | 1.5 | 0.75 | 1.25 |
| Water | Balance | Balance | Balance | Balance | Balance |
| TOTAL | 100 | 100 | 100 | 100 | 100 |

[a]Sucrose fatty ester = sucrose fatty ester derived from soy bean oil with average esterification of 7.5 on each sucrose, available from Twin River Technologies.
[b]DTDMAC = di-tallow di-methyl ammonium chloride, available from Fluka.
[c]Polyvinylamine (PVAm) from BASF under the trade name Lupamin ® 5095.
[d]Cationically modified starch having a charge density of 0.36 meq/gram and WF = 84, available from National Starch.

Comparative Example

In comparison, a different fabric softener and static control formulation package is used in a commercial fabric care composition under the trade name Downy Ultra®. This composition comprises about 14% BFA (dimethyl bis(stearoyl oxyethyl)ammonium chloride), about 2% HCP, about 1.5% perfume, and the balance water.

Perfume Deposition

Fabric swatches are treated according to the Fabric Sample Preparation procedure and the perfume ingredients released from the treated fabric swatches are measured according to HSGC Test Method.

In the above test, Example I and II compositions provide enhanced perfume delivery of Quadrant IV, enduring perfume ingredients, and surprisingly, the more challenging Quadrant I perfume ingredients, relative to the perfume delivery of the same ingredients provided by the Comparative Example (the Control). It is worth noting that enhanced delivery of the following perfume ingredients is achieved: including Quadrant I perfume ingredients such as anisic aldehyde, phenyl ethyl alcohol, and benzyl acetate; and Quadrant IV perfume ingredients such as lilial (p-t-bucinal)®, phenyl ethyl phenyl acetate, hexyl cinnamic aldehyde, iso-E-super®, gamma-ionone, gamma-n-methyl ionone and peonile.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

All documents cited are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A fabric care composition comprising a non-encapsulated mixture of:

(a) one or more nonionic fabric softeners comprising sucrose ester;

(b) optionally, a quaternary ammonium compound;

(c) a deposition agent comprising a polymer having primary or secondary amine moieties and a weight average molecular weight of from about 10,000 to about 2,100,000 Daltons;

(d) a cationic polysaccharide; and (e) a perfume accord comprising Quadrant I perfume ingredients having a boiling point less than about 250° C. and a ClogP of less than about 3.0;

wherein sucrose ester is the predominant component of said fabric softener; and the weight ratio of nonionic fabric softener to deposition agent ranges from about 300:1 to about 3:1.

2. The composition according to claim 1 wherein the nonionic fabric softener further comprises polyhydric alcohols and anhydrides selected from the group consisting of sorbitan esters, glycerol esters, polyglycerol esters, and mixtures thereof.

3. The composition according to claim 1 wherein the sucrose ester has the formula:

$$M(OH)_{8-x}(OC(O)R^1)_x$$

wherein $M(OH)_8$ is sucrose in which M is the main backbone of the sucrose and (OH) represents the available hydroxyl groups on a sucrose molecule;

x is an integer selected from 1 to 8; and $R^1$ is independently selected from C1-C22 alkyl or C1-C30 alkoxy, linear or branched, cyclic or acyclic, saturated or unsaturated, substituted or unsubstituted.

4. The composition according to claim 1 wherein the pH of the composition ranges from about 5.5 to about 8.5.

5. The composition according to claim 1 wherein the pH of the composition ranges from about 6.5 to about 8.0.

6. The composition according to claim 1 comprising said quaternary ammonium compound.

7. The composition according to claim 1 wherein the deposition agent is selected from the group consisting of polyvinylamine, polyalkyleneimines, polyaminoacids, amino substituted polyvinylalcohols, polyoxyethylene bis-amine or bis-aminoalkyl, derivatives thereof, and mixtures thereof.

8. The composition according to claim 1 wherein the deposition agent is a polyvinyl amine having a weight average molecular weight from about 100,000 to about 2,100,000 Daltons.

9. The composition according to claim 1 wherein the perfume accord further comprises enduring perfume ingredients having a boiling point of about 250° C. or higher and a ClogP of about 3.0 or higher.

10. The composition according to claim 1 further comprising a dispersing medium selected from the group consisting of water, C4 to C10 glycol ethers, C2 to C7 glycols, polyethers, and mixtures thereof.

11. The composition of claim 1 wherein the cationic polysaccharide is selected from the group consisting of cationic guar gums, cationic cellulose derivatives, hydrolyzed cationic starch, cationic chitosan derivatives, and mixtures thereof.

12. A method for treating fabric articles comprising the step of contacting the fabric articles with the composition according to claim 1.

* * * * *